US006539871B2

(12) United States Patent
Englar et al.

(10) Patent No.: US 6,539,871 B2
(45) Date of Patent: Apr. 1, 2003

(54) DEGRADABLE PRACTICE MINE

(75) Inventors: Scott A. Englar, Brooklyn Park, MN (US); Richard W. Rentfrow, Blacksberg, VA (US); Wesley G. Marquette, Edina, MN (US); Robert E. Long, Hillman, MN (US)

(73) Assignee: Alliant Techsystems Inc., Edina, MN (US)

( * ) Notice: Subject to any disclaimer, the term of this patent is extended or adjusted under 35 U.S.C. 154(b) by 0 days.

(21) Appl. No.: 09/821,219

(22) Filed: Mar. 29, 2001

(65) Prior Publication Data

US 2002/0178958 A1 Dec. 5, 2002

(51) Int. Cl.[7] ..... F42B 23/00; F42B 8/28; F42B 12/00; F42B 8/12

(52) U.S. Cl. ..... 102/401; 102/407; 102/498; 102/529; 86/54; 89/1.51

(58) Field of Search ..... 102/401, 353, 102/407, 498, 529, 395; 89/1.51; 86/54, 55

(56) References Cited

U.S. PATENT DOCUMENTS

| | | | | |
|---|---|---|---|---|
| 1,677,034 A | * | 7/1928 | Kohn | 102/353 |
| 2,108,818 A | * | 2/1938 | Huff et al. | 102/395 |
| 2,502,442 A | * | 4/1950 | Driskell | 102/395 |
| 2,607,294 A | * | 8/1952 | Lindman | 102/394 |
| 2,936,709 A | * | 5/1960 | Seavey | |
| 4,005,657 A | * | 2/1977 | Rothman | 102/353 |
| 4,218,974 A | * | 8/1980 | Heinemann | |
| 4,270,435 A | * | 6/1981 | Hurst | |
| 5,216,198 A | * | 6/1993 | Bourgin | 102/401 |
| 5,370,056 A | * | 12/1994 | Huang | 102/353 |
| 5,511,482 A | | 4/1996 | DiPietropolo | |
| 5,883,330 A | * | 3/1999 | Yoshida | |

FOREIGN PATENT DOCUMENTS

| | | |
|---|---|---|
| FR | 2 371 665 | 6/1978 |
| FR | 2 364 425 | 4/1998 |

OTHER PUBLICATIONS

Material Safety Data Sheet, Powders, GMBOND(TM),U.S. Dept. of Labor, undated.

* cited by examiner

*Primary Examiner*—Michael J. Carone
*Assistant Examiner*—Lulit Semunegus
(74) *Attorney, Agent, or Firm*—George A. Leone

(57) ABSTRACT

A method for making a degradable practice mine including the steps of covering a flat work surface with a polyethylene sheet to serve as a release film, weighing out the materials in a ratio of 10 parts sand to 1 part polyvinyl alcohol (PVA), mixing 1 part PVA with 10 parts sand making a sand/PVA mixture, filling a mold with the sand/PVA mixture, consolidating the sand/PVA mixture to make a consolidated form in the shape of a mine, and heating the consolidated form to make a hardened mine form mimicking the shape and launching characteristics of a tactical mine.

12 Claims, 2 Drawing Sheets

DEGRADABLE PRACTICE MINE

BACKGROUND OF THE INVENTION

The present invention relates to the field of inert practice mines, and, more particularly, to environmentally safe, degradable mines.

Practice mines are inert mines that mimic tactical mines in their shape, weight, launch and flight characteristics. Practice mines are very important to training personnel in proper procedures and responses when using a scatterable mine system. However, in order to protect the environment, practice mines from scatterable mine systems currently require recovery and cleaning after use. One type of practice mine launching system is described in U.S. patent application Ser. No. 09/592,481, to Klukas et al., entitled Reusable Training Dispenser, having a filing date of Jun. 9, 2000 and assigned to the assignee of this patent application. U.S. patent application Ser. No. 09/592,481 is incorporated by reference herein. The Reusable Training Dispenser presents a metal dummy mine that matches the weight, launch and flight characteristics of a tactical mine almost exactly.

Unfortunately, procedures for recovery and cleaning of existing metallic practice mines are time consuming, inefficient, and expensive. The elimination of this low value-added step of recovery and cleaning would allow more efficient and cost-effective training procedures. Thus, the existence of a practice mine that can be left in place to rapidly degrade into a non-obtrusive natural substance would eliminate the time and expense of recovering practice mines. Until now, such a useful, degradable, practice mine has not been available.

The assignee of the present invention previously experimented with a mine fabricated from peat to fill the need for a degradable mine, but did not further pursue this type of mine by patenting or marketing because it did not meet the overall requirements. The unsuccessful peat mine was lower in weight than a tactical mine and had a tendency to break up during launching and/or landing.

The present invention overcomes the drawbacks of currently available practice mines by, for the first time, providing a degradable practice sand mine that requires no extra effort to recover once it has been launched from a scatterable mine system. At the same time, a degradable practice mine contemplated by the present invention nearly matches the weight of a tactical mine and has characteristics that allow it to survive launching from a mine launching tube and landing while maintaining its shape. The invention takes advantage of the fact that sand is a very unobtrusive substance that is not likely to cause any environmental damage in the areas where training is taking place.

SUMMARY OF THE INVENTION

A method for making a degradable practice mine including the steps of covering a flat work surface with a polyethylene sheet to serve as a release film, weighing out the materials, mixing polyvinyl alcohol (PVA) with sand making a sand/PVA mixture, filling a mold with the sand/PVA mixture, consolidating the sand/PVA mixture to make a consolidated form in the shape of a mine, and heating the consolidated form to make a hardened mine form mimicking the shape and launching characteristics of a tactical mine.

In one aspect the invention provides a degradable practice mine that nearly matches the weight of a tactical mine, and that can survive launching from an air gun mine launching tube, and subsequently landing while maintaining its shape.

In another aspect of the invention a degradable practice mine is comprised of sand, since sand is a very unobtrusive substance that is not likely to cause any significant environmental damage in the areas where training is taking place.

An advantage of the invention is that it provides a degradable practice mine comprising natural substances that degrade rapidly when exposed to sunlight and water.

In another aspect the invention provides a degradable practice mine that can be painted to meet color-coding requirements, and coated with paraffin wax to improve handling and storage.

In another aspect the invention provides a degradable practice mine designed to have nearly the same weight as the tactical mine that is used in scatterable mine systems, thereby having launch and flight characteristics nearly matching characteristics of the tactical mine.

In another aspect the invention provides a degradable practice mine having few complex features to allow for simple molding.

It is one object of the invention to provide a degradable practice mine for field trials and training that does not require retrieval from the field in order to prevent harm to the environment.

DETAILED DESCRIPTION OF THE PREFERRED EMBODIMENTS

Figure 2:
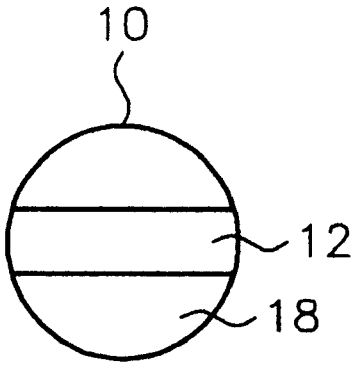
FIG. 2 illustrates a bottom view schematic of an exemplary practice mine as used in one embodiment of the invention.
Figure 1:
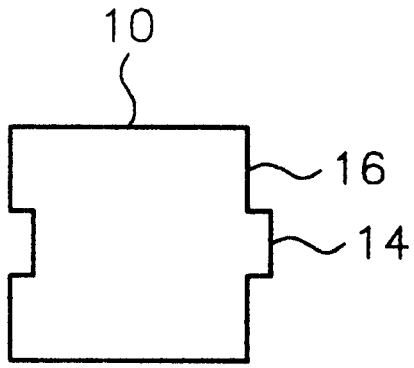
FIG. 1 illustrates a side view schematic of an exemplary practice mine as used in one embodiment of the invention.

While the invention will be described herein with respect to certain specific useful embodiments, it will be understood that these examples are by way of illustration and that the invention is, not limited by these examples. Referring now jointly to FIG. 1 and FIG. 2, FIG. 1 illustrates a side view schematic of an exemplary practice mine as used in one embodiment of the invention, and FIG. 2 illustrates a bottom view schematic of an exemplary practice mine as used in one embodiment of the invention.

In one embodiment, a degradable practice mine 10 has a generally cylindrical shape. When configured for one type of air gun launcher, the practice mine 10 may advantageously include features mimicking actual tactical mines. Such features include a raised portion 14 on its top 16 and a corresponding groove 12 on the bottom 18 of the practice mine. The groove 12 accepts a strap used in some mine launching systems. The raised portion 14 may have a generally rectangular surface and may be used to promote stacking and loading into a practice reloadable scatterable mine system canisters such as the canister described in U.S. patent application Ser. No. 09/592,481.

It can be seen that the degradable practice mine has few complex features, thereby simplifying molding using. Other features may be molded or cast into the degradable practice mine as desired or required by particular applications. Further, the shape of a practice mine constructed in accordance with the present invention is not limited to the examples described herein.

Materials required for making one type of degradable practice mine in accordance with this invention include sand and polyvinyl alcohol (PVA), in a mixture as described above, standard grade paraffin wax, and a release film. The release film may comprise a Teflon®-coated glass sheet or polyethylene sheet. In one useful embodiment of the invention made by Alliant Techsystems Inc. of Hopkins, Minn., a practice mine comprised a sand composition as indicated in Table I.

TABLE I

| Sand Composition | |
|---|---|
| Sieve | Percent |
| 40 | 0.5 |
| 50 | 14.5 |
| 60 | 40.4 |
| 100 | 31.9 |
| 140 | 11.0 |
| Pan | 1.7 |

The mixture shown in Table I is generally available. One source is Badger Blast Sand, Taylor Plant Fairwater, Wis. Another useful sand mixture is designated BB#9T (No. 70) and available from Sterling Supply, Minnesota.

In one example, the sand composition described above was mixed with polyvinyl alcohol (PVA) by weighing out a predetermined amount of sand to a lesser predetermined amount of polyvinyl alcohol (PVA). In one useful embodiment, a mixture ratio of sand: PVA of 10:1 by weight was used. PVA is generally available, and one useful type is sold under the name Partall Film No. 10 available from Rexco, Santa Barbara, Calif.

Figure 3:
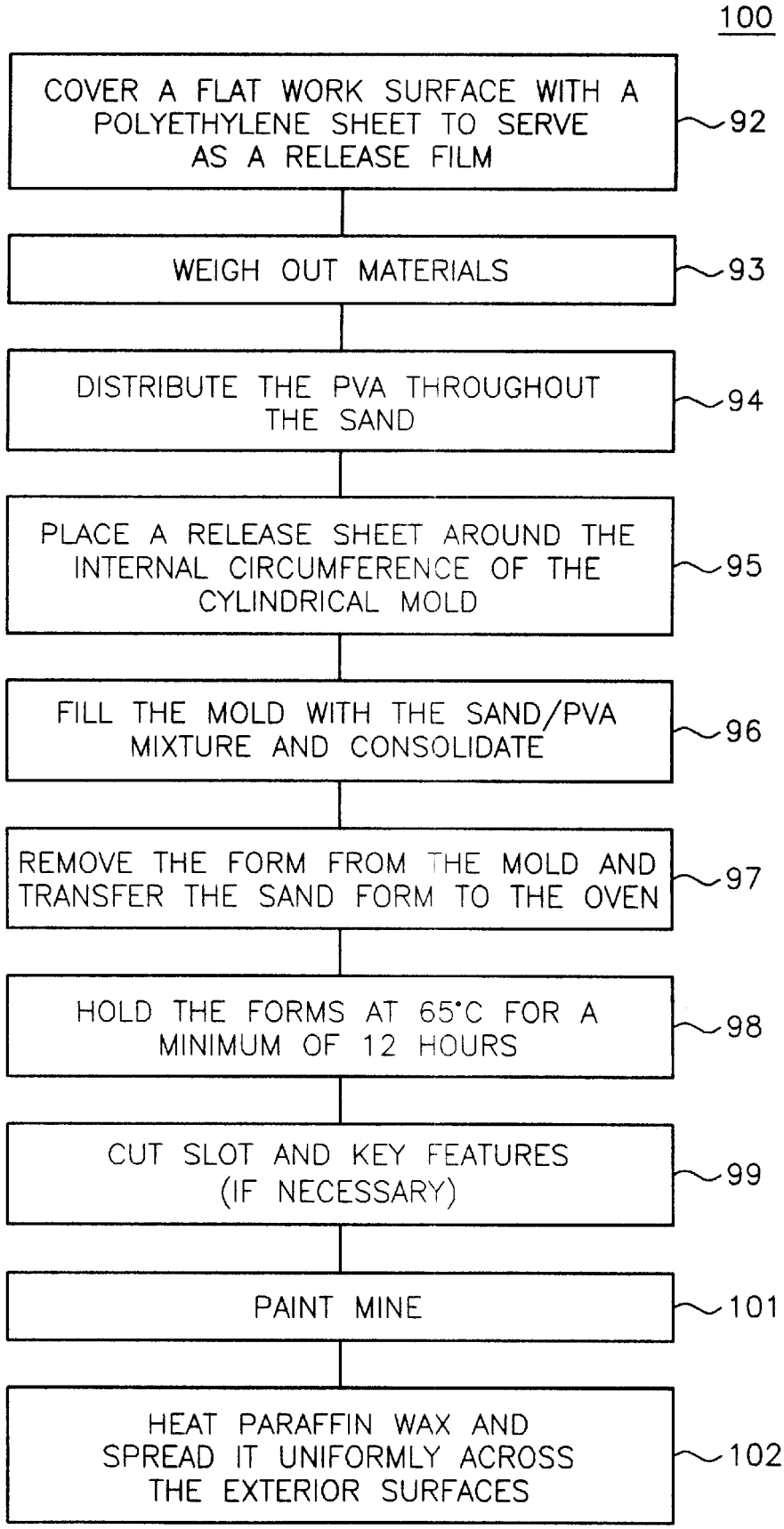
FIG. 3 shows a diagram of an example of a method for making a degradable practice mine configuration as contemplated by one embodiment of the invention.

Referring now to FIG. 3, a diagram of an example of a method for making a degradable practice mine configuration as contemplated by one embodiment of the invention is shown. This is one method for molding, biodegradable practice mines using sand with a PVA binder. In implementing the method the following equipment, or its equivalent, is needed:

a vented oven capable of maintaining 65° C. for a minimum of 12 hours, cylindrical molds to form the near net shape of the mine, where the molds are designed according to known molding techniques, a trim fixture to produce the interlock features on the mine, alternatively, the features may be molded in place with the cylindrical mold, an arbor/hydraulic press to aid in compaction, and a heat source to melt paraffin wax.

The trim fixture may be, for example, a hacksaw, file or equivalent.

As shown in FIG. 3, one procedure 100 for making a degradable practice mine includes the following steps:

Step 92. Covering a flat work surface with a polyethylene sheet to serve as a release film.

Step 93. Weighing out sand and PVA in a ratio of at least 10 parts sand to at least 1 part PVA.

Step 94. Using a blade or tumbler to fully mix to evenly distribute the PVA throughout the sand.

Step 95. Placing a release sheet around the internal circumference of the cylindrical mold.

Step 96. Filling the mold with the sand/PVA mixture and initially tamping down to consolidate. Finish the consolidation with a press using a ram load of approximately 500 kg.

Step 97 Removing the form from the mold with the aid of the release sheet and transferring the sand form to the oven.

Step 98. Heating the forms at 65° C. for a minimum of 12 hours.

Step 99. Placing the hardened mine form in a trim fixture and cutting the slot and key features, if they are not already molded.

Step 101 Painting the mine to designate that it is an inert practice mine.

Step 102 Heating paraffin wax and spreading it uniformly across the exterior surfaces.

The painting step 101, is necessary only in those applications having color-coding requirements. After painting, practice mines are coated with paraffin wax 102 to improve handling and storage characteristics of the practice mines.

In an alternate example embodiment, a protein-based binder may be used in place of PVA. Hormel Foods Corporation of Austin, Minn., USA, sells one such binder under the brand name GMBOND™. GMBOND™ sand binder is a non-toxic, protein-based sand binder that reduces toxic gas emissions, and eliminates the use of toxic chemicals. According to the manufacturer's data sheets, as presently constituted, GMBOND includes the following ingredients: a blend of amino acids (protein product 99.5% minimum), which may also contain, ironoxide (0–0.1%), methylparaben (0–0.1%), propylparaben; (0–0.1%), benzalkoniumchloride (0–0.1%), sodiumbenzoate (0–0.1%).

The invention has been described herein in considerable detail in order to comply with the Patent Statutes and to provide those skilled in the art with the information needed to apply the novel principles of the present invention, and construct and use such exemplary and specialized components as are required. However, it is to be understood that the invention may be carried out by specifically different equipment and devices, and that various modifications, both as to the equipment details and operating procedures, may be accomplished without departing from the true spirit and scope of the present invention.

What is claimed is:

1. A method for making an inert degradable practice mine comprising the steps of:

(a) covering a flat work surface with a polyethylene sheet to serve as a release film;

(b) weighing out a predetermined amount of sand to a lesser predetermined amount of polyvinyl alcohol (PVA);

(c) mixing to evenly distribute the PVA throughout the sand making a sand/PVA mixture;

(d) providing a cylindrical mold having an internal circumference and placing a release sheet around the internal circumference of the cylindrical mold;

(e) filling the cylindrical mold with the sand/PVA mixture;

(f) consolidating the sand/PVA mixture to make a consolidated form;

(g) removing the consolidated form from the cylindrical mold; and (h) heating the consolidated form at a predetermined temperature for a predetermined time period to make an inert degradable hardened mine form mimicking the shape and launching characteristics of a tactical mine.

2. The method for making a degradable practice mine of claim 1 further comprising the step of placing the hardened mine form in a trim fixture and cutting external features.

3. The method for making a degradable practice mine of claim 1 further comprising the step of painting the hardened mine form to designate that it is an inert practice mine.

4. The method for making a degradable practice mine of claim 3 wherein the step of painting includes using blue coloring.

5. The method for making a degradable practice mine of claim 1 further comprising the step of heating paraffin wax and spreading it uniformly across exterior surfaces of the hardened mine form.

6. The method for making a degradable practice mine of claim 1 wherein the predetermined temperature is at least 65° C. and the predetermined time period is a minimum of 12 hours.

7. The method for making a degradable practice mine of claim 1 wherein the cylindrical mold includes forms for external features.

8. A method for making an inert degradable practice mine comprising the steps of:

(a) covering a flat work surface with a polyethylene sheet to serve as a release film;

(b) weighing out at least 10 parts sand to at least 1 part binder;

(c) mixing to evenly distribute the binder throughout the sand making a sand/binder mixture;

(d) providing a cylindrical mold having an internal circumference and placing a release sheet around the internal circumference of the cylindrical mold, wherein the cylindrical mold includes forms for external features;

(e) filling the cylindrical mold with the sand/binder mixture;

(f) consolidating the sand/binder mixture to make a consolidated form;

(g) removing the consolidated form from the cylindrical mold;

(h) heating the consolidated form at a predetermined temperature for a predetermined time period to make an inert degradable hardened mine form mimicking the shape and launching characteristics of a tactical mine;

(i) painting the inert degradable hardened mine form to designate that it is an inert practice mine; and (j) heating paraffin wax and spreading it uniformly across exterior surfaces of the inert degradeable hardened mine form.

9. The method of claim 8 wherein the binder is polyvinyl alcohol (PVA).

10. The method of claim 8 wherein the binder is a protein-based binder.

11. A degradable practice mine made according to the method of claim 1.

12. An inert degradable practice mine made according to the method of claim 8.

* * * * *

UNITED STATES PATENT AND TRADEMARK OFFICE

CERTIFICATE OF CORRECTION

PATENT NO. : 6,539,871 B1
DATED : April 1, 2003
INVENTOR(S) : Englar et al.

It is certified that error appears in the above-identified patent and that said Letters Patent is hereby corrected as shown below:

Column 6,
Line 12, replace “degradeable” with -- degradable --.

Signed and Sealed this

Thirteenth Day of January, 2004

JON W. DUDAS
*Acting Director of the United States Patent and Trademark Office*